US005471906A

United States Patent [19]

Bachner, Jr. et al.

[11] Patent Number: 5,471,906

[45] Date of Patent: Dec. 5, 1995

[54] BODY ARMOR COVER AND METHOD FOR MAKING THE SAME

[75] Inventors: Thomas E. Bachner, Jr., Unionville, Pa.; David J. Pacanowsky, North East, Md.

[73] Assignee: W. L. Gore & Associates, Inc., Newark, Del.

[21] Appl. No.: 137,861

[22] Filed: Oct. 15, 1993

[51] Int. Cl.[6] ..... F41H 5/08

[52] U.S. Cl. ..... 89/36.05; 89/36.02; 2/2.5; 2/92; 428/911; 109/49.5

[58] Field of Search ..... 89/36.05, 36.02; 2/2.5, 92; 428/911; 109/49.5

[56] References Cited

U.S. PATENT DOCUMENTS

| | | | |
|---|---|---|---|
| 1,398,682 | 11/1921 | De Dragic | 89/36.05 |
| 2,640,987 | 6/1953 | Ehlers | 2/2.5 |
| 2,773,791 | 12/1956 | MacIver | 89/36.05 |
| 3,953,566 | 4/1976 | Gore | 264/288 |
| 4,098,742 | 7/1978 | Mueller | 428/911 |
| 4,194,041 | 3/1980 | Gore et al. | 428/315 |
| 4,532,316 | 7/1985 | Henn | 528/59 |
| 4,660,223 | 4/1987 | Fritch | 428/911 |
| 4,774,724 | 10/1988 | Sacks | 2/2.5 |
| 4,862,730 | 9/1989 | Crosby | 73/38 |
| 4,942,214 | 7/1990 | Sakhpara | 528/59 |
| 5,008,959 | 4/1991 | Coppage, Jr. et al. | 2/2.5 |
| 5,308,689 | 5/1994 | Shinkai et al. | 428/911 |
| 5,327,811 | 7/1994 | Price et al. | 89/36.05 |

FOREIGN PATENT DOCUMENTS

| | | |
|---|---|---|
| 2348991 | 11/1977 | France . |
| 2444248 | 7/1980 | France . |
| 9118069 | 11/1991 | WIPO . |

OTHER PUBLICATIONS

Literature: Second Chance® Body Armor; 32 pages, Second Chance Body Armor, Inc, 1992.

Literature: Second Chance Body Armor, Inc., Superfeatherlite™ Soft Core™ Series, Date: Unknown, 4 pages.

Literature: U.S. Cavalry, Guardian Technologies, International Body Armor, Date: Unknown, 1 page.

ASTM D751–89 Standard Test Methods for Coated Frabrics pp. 1–18.

ASTM Standard F316–86 Standard Test Methods for Pore Size Characteristics of Membrane Filters by Bubble Point and Mean Flow Pore Test; pp. 1–9.

ASTM D–882–91 Standard Test Methods for Tensile Properties of Thin Plastic Sheeting, pp. 1–9.

ASTM D726–89 Standard Test Methods for Resistance of Nonporous Paper to Passage of Air pp. 117–118.

*Primary Examiner*—Stephen M. Johnson
*Attorney, Agent, or Firm*—David J. Johns

[57] ABSTRACT

An improved body armor for use in protecting a wearer from penetration injuries from bullets and other hazards is disclosed. The body armor employs a waterproof/moisture vapor permeable cover over flexible armor plating layer or layers which improves breathability of the armor. Additionally, the waterproof nature of the cover allows for use of more flexible armor materials which has not be treated to be water repellent. As a result, a more wearable and, thus, effective body armor is created.

20 Claims, 3 Drawing Sheets

BODY ARMOR COVER AND METHOD FOR MAKING THE SAME

BACKGROUND OF THE INVENTION

1. Field of the Invention

The present invention relates to "bullet-proof" vests and other forms of body armor worn to protect against penetration injuries, such as by bullets, shot, shell fragments, and other weaponry.

2. Description of Related Art

Certain occupations have become so dangerous in recent times that body armor, such as so-called "bullet-proof" vests, have become a standard accessory issued for protection from commonly encountered violence. In addition to military wear, body armor is regularly provided to police and other law enforcement agents, emergency medical personnel, security guards, and many other people who expect to encounter guns and other threats in daily activities.

While increased violence has fueled interest in such armor, advances in penetration-resistant and trauma-resistant technology have made possible the widespread availability of such protection. Perhaps the greatest improvement in this area has been the development of certain synthetic ballistic materials which are highly effective at resisting penetration while being relatively flexible and lightweight. The best known of such materials is a aramid fiber available from E. I. duPont de Nemours and Company, Wilmington, Del., under the trademark KEVLAR. When woven into a fabric and stacked in relatively few layers (e.g. 15 to 30), this material is tremendously resistant to projectile penetration while still being thin enough, light enough, and flexible enough to be worn under essentially conventional clothing. Numerous lives have been saved as a result of the availability of such materials.

Unfortunately, these materials have a number of serious constraints. The United States military has determined that when untreated woven ballistic materials are saturated with water or similar liquid, they lose a significant portion of the ability to stop bullets or shell fragments. In order to correct this condition, it is common practice today to take a number of steps to impart water resistance to the ballistic fabric.

One approach to water saturation problems is to treat each layer of the ballistic material with a waterproofing agent. This technique is effective, but tends to stiffen the ballistic material-decreasing its flexibility and making it more uncomfortable to wear. An additional or alternative approach is to cover the final armor material with an impermeable waterproof material. This helps isolate the ballistic material from water sources, but is uncomfortable against the wearer because the impermeable material does not allow the wearer's skin to "breathe."

Even though body armor employing both of these water-resistance techniques will pass most common test criteria, these products tend to fail the most important criteria for safety—wearability. It has been found that an unnecessary cause of personal injury is the wearer's reluctance to wear this armor on a regular basis. Stiffened waterproof ballistic fabric and nonbreathable covers conspire to make the typical body armor "hot" and uncomfortable for long term wear. The problem of comfort and bulk is compounded in warmer climates where heat and humidity make breathability crucial and where lighter weight outer clothing provide minimal coverage for bulky vests.

One approach to the problem of breathability has been addressed by placing the ballistic material within a washable, breathable carrier. The carrier is generally made from a cotton or absorbent synthetic which provides some wicking of moisture away from the wearer's skin. Additionally, the carrier is often made to be separated from the armor "panel," thus allowing for frequent laundering. Regretfully, the relief offered by such materials is relatively minimal, while the carrier itself can add additional bulk to the final product.

Accordingly, it is a primary purpose of the present invention to provide a body armor which is highly effective at stopping penetration even under wet conditions while being breathable and comfortable to wear.

It is another purpose of the present invention to provide a body armor which is more flexible and conforming to body types and shapes than presently available waterproof armors.

It is a further purpose of the present invention to provide a body armor which more accommodating in its applications, allowing for comfortable and serviceable designs without the use of accessories such as carriers.

These and other purposes of the present invention will become evident from review of the following specification.

SUMMARY OF THE INVENTION

The present invention provides an improved cover for use in protecting armor panels used in a variety of body armors, and a method for constructing such a cover.

The body armor of the present invention comprises a penetration resistant armor layer, and a waterproof/moisture vapor permeable cover surrounding and sealing the armor layer. Preferably, the cover comprises an expanded porous polytetrafluoroethylene (PTFE) membrane laminated to a fabric material such as nylon or similar material.

The cover serves to isolate the armor plating from water, perspiration, or other liquids which can compromise its penetration resistance while allowing a wearer's perspiration to freely dissipate from his or her skin. As a result the cover is "breathable," vastly improving the comfort of the body armor for the wearer.

Additionally, by effectively sealing the armor layer within a waterproof cover, the armor layer need not be separately waterproofed. This reduces the cost of producing such layers and significantly improves its flexibility, conformability, and, perhaps, its own breathability.

As a result, body armor employing the present invention is thoroughly water resistant while being more breathable and comfortable to wear and more flexible and less binding than previously available body armors. Hence, body armor made in accordance with the present invention is likely to be worn more often and, accordingly, to be more likely to save lives than any presently available body armors.

DESCRIPTION OF THE DRAWINGS

The operation of the present invention should become apparent from the following description when considered in conjunction with the accompanying drawings, in which.

DETAILED DESCRIPTION OF THE INVENTION

The present invention is an improved pad for use in various body armor products. As used herein, the term "body armor" is intended to include any form of material worn against a body (human or animal) to protect against penetration injuries, such as those inflicted by bullets, shot, shell fragments, cutting instruments, etc.

Figure 1:
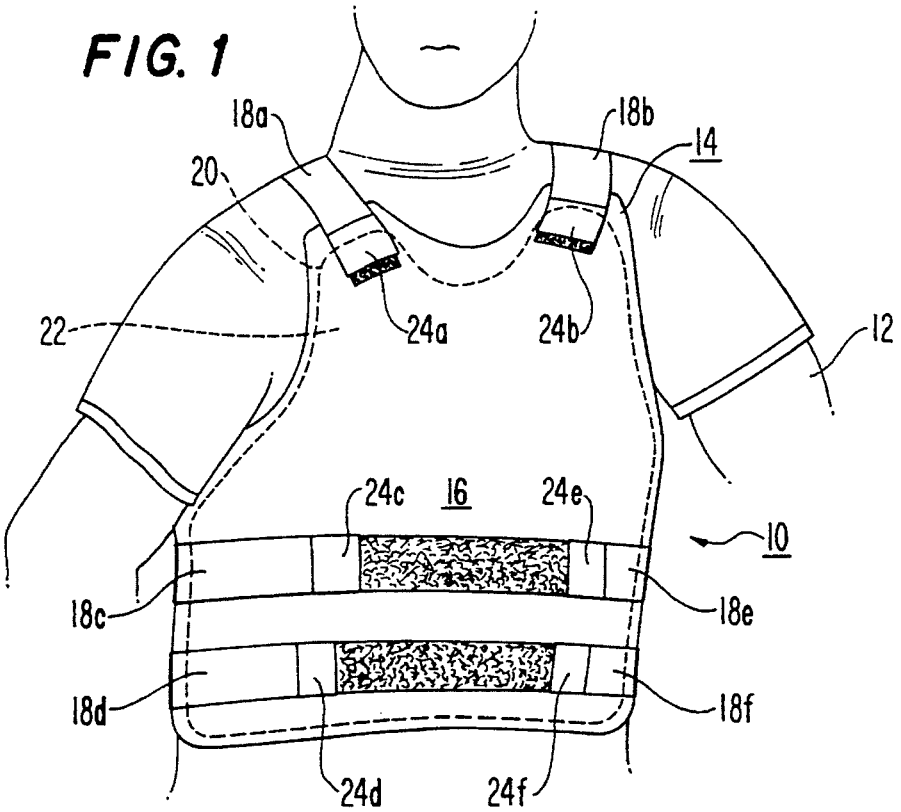
FIG. 1 is a front perspective view of one embodiment of a body armor vest of the present invention shown as worn.

Shown in FIG. 1 is a body armor vest 10 of a general six point adjustable design worn under the outer clothes of a wearer 12. The vest comprises a cloth carrier 14 having a front 16 and a back (not shown), multiple straps 18*a*, 18*b*, 18*c*, 18*d*, 18*e*, 18*f* attaching the vest around the wearer 12, and internal pockets 20 (front and back) or other attachment means for removably retaining the pads of armor panel 22.

As is explained in greater detail below, a carrier 14 is not required for use with the present invention. Nevertheless, the use of a carrier 14 generally provides better comfort for the wearer and allows for easier laundering of the body armor (i.e. the armor panel can be removed from the carrier and the carrier can be cleaned in a conventional manner). The carrier 14 can be constructed from any suitable material, but preferably from a comfortable absorbent material such as cotton or an absorbent synthetic material (e.g. COOLMAX fabric available from E. I. duPont de Nemours and Company).

As is shown, by providing means to attach the straps 18 to the carrier 14, such as snaps or the hook and loop fasteners 24*a*, 24*b*, 24*c*, 24*d*, 24*e*, 24*f* shown, the straps can be adjusted to form a proper fit around the wearer 12.

Figure 2:
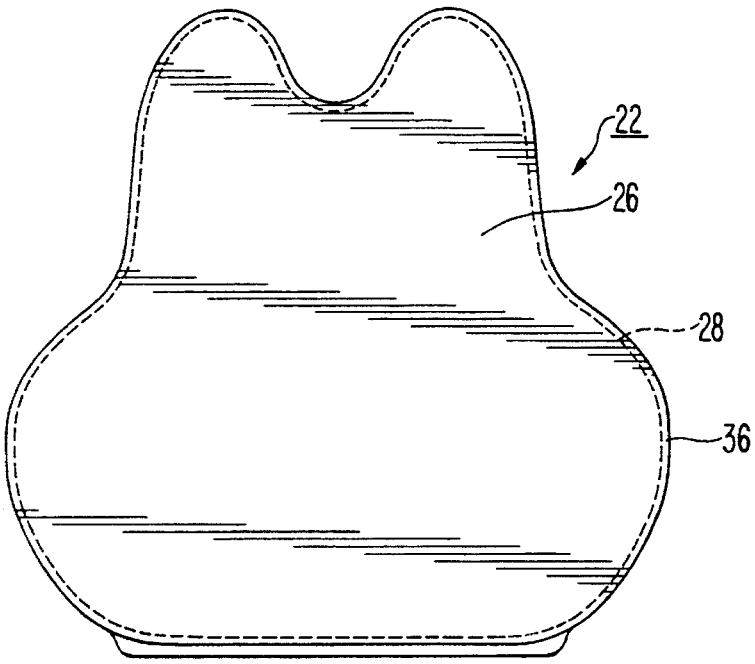
FIG. 2 is an elevational view of a front covered ballistic pad of the present invention.
Figure 3:
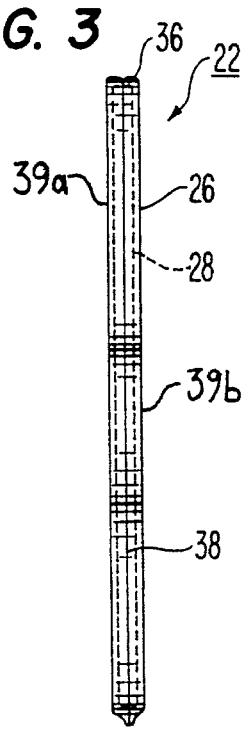
FIG. 3 is a side view of the ballistic pad of FIG. 2.

FIGS. 2 and 3 show an armor panel 22 of the present invention. The panel 22 comprises a cover 26 containing a penetration-resistant armor layer 28. The armor layer is preferably multiple layers of flexible penetration-resistant fabric, such as woven aramid fibers sold by E. I. duPont de Nemours and Company under the trademark KEVLAR, such as KEVLAR Type 29 or 129. Many other materials may be equally suitable for use with the present invention, including SPECTRA SHIELD non-woven reinforced plastic and SPECTRA woven fabrics available from Allied Signal, Inc., Morristown, N.J., and TWARON CT2000 aramid fibers available from AKZO Chemical Company.

Figure 4:
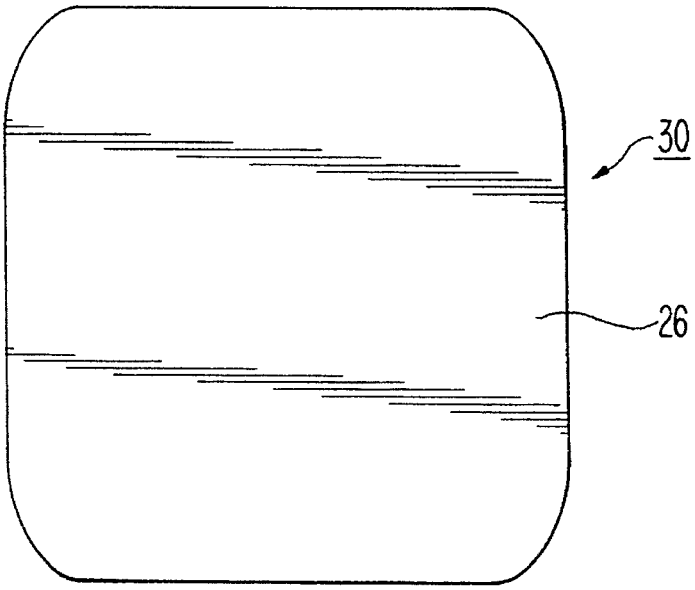
FIG. 4 is an elevational view of one embodiment of a back covered ballistic pad of the present invention.

For the back side of the body armor vest, a different shaped panel 30 such as that shown in FIG. 4 may be employed. As is noted below, the shapes and types of panels of the present invention can be readily modified to address specific operational demands.

The type and number of layers of armor plating material employed depends upon many factors, including the degree of threat anticipated, the parts of the body protected, the conditions under which the body armor is to be used, etc. For example, the National Institute of Justice "Technology Assessment Program" has established Specification NIJ-STD-0101,03 "Ballistic Resistance of Police Body Armor" (April 1987). The following chart summarizes these standards:

| "Threat Level" | Bullet Type: | NIJ SPEC. "Maximum Velocity" M/sec. |
|---|---|---|
| II-A | .357 Mag. 159 gr JSP | 381 |
| | 9 mm 124 gr FMJ | 332 |
| II | .357 Mag. 158 gr JSP | 425 |
| | 9 mm 124 gr FMJ | 358 |
| IIIA | .44 Mag. 240 gr. SWCGC | 427 |
| | 9 mm 124 gr FMJ | 427 |

For use in the present invention, a threat level of IIA can be met with about 16 to 20 plies of 840 denier, 31×31 picks and ends per inch, 6.8 oz/yd$^2$ (933 dTex, 12×12 picks and ends per centimeter, 231 gm/m$^2$) KEVLAR 129 fabric; a threat level of II can be met with about 20 to 24 plies of such material; and a threat level of IIIA can be met which about 26 to 30 plies of such material. Other configurations can be used.

The flexibility of the armor panel layer of the present invention is greatly enhanced by not treating the material with any form of waterproofing agent. As a result, the material is far more flexible, form fitting, and comfortable than many previously available materials.

Figure 5:
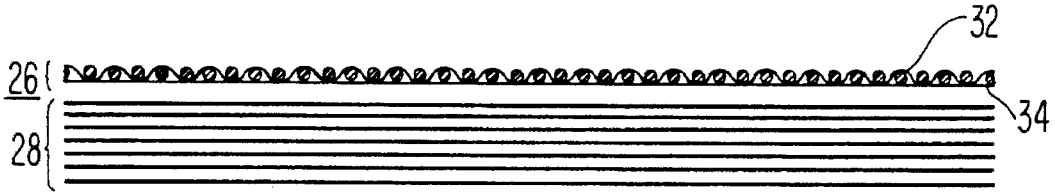
FIG. 5 is a cross-sectional view of a cover and a portion of an armor layer of the ballistic pad of the present invention.

In order to safely avoid waterproofing the armor layers without compromising the body armor under wet conditions, the present invention employs a unique cover 26 comprising a waterproof yet breathable fabric. As is shown in FIG. 5, the ideal material comprises a fabric material 32 (e.g. nylon, rip-stop nylon, or absorbent synthetic such as COOLMAX polyester fabric) laminated to or coated with a breathable material 34 which is liquid water repellent while allowing moisture vapor to pass freely through the breathable material. In this way, perspiration from the wearer's skin can dissipate through the breathable material 34 in a vapor form, but cannot re-penetrate the material 34 as a condensate.

Suitable breathable materials include fabric coated with a breathable polymer such as certain polyurethanes. They also include fabric laminated with a breathable film or membrane. Such films or membranes include porous polyolefins, porous fluorinated polymers, and the like.

Preferably, the material 34 employed in the present invention comprises a sheet of porous fluorocarbon, and especially polytetrafluoroethylene (PTFE) which has been expanded to create a network of fibrils interconnecting polymeric nodes. This material is resistant to water penetration while permitting the transmission of moisture vapor through it. Such a product can be produced in a known manner, such as in accordance with the teachings of U.S. Pat. No. 3,953,566 issued Apr. 27, 1976, to Gore.

One concern with this material is that its ballistic properties and waterproof properties can be compromised by contamination with certain oils, such as those excreted by the body in perspiration. This problem can be corrected by treating one side of the expanded PTFE membrane with a continuous coating of a hydrophilic/oleophobic material such as polyurethane which permits the passage of moisture vapor but shields the expanded PTFE material from oil contamination. One such laminate is disclosed in U.S. Pat. 4,194,041 issued Mar. 18, 1980, to Gore et al. Other polyurethanes which may be useful for this purpose are described in U.S. Pat. 4,532,316 issued Jul. 30, 1985, to Henn, and 4,942,214 issued Jul. 17, 1990, to Sakhpara.

Suitable coated expanded membrane materials which can be employed in the present invention are manufactured in a variety of forms by W. L. Gore & Associates, Inc., of Elkton, Md., under the trademark GORE-TEX®. The preferred membrane material comprises a composite expanded PTFE film coated with a continuous hydrophilic/oleophobic polyurethane layer. This material is identified by W. L. Gore & Associates, Inc. under specification Part Number 20048-1, Level 3, ISO 9000.

By way of example, one membrane believed suitable for use in the present invention comprises a composite with the follow characteristics: (1) a microporous expanded PTFE membrane having a mass of about 17 g/m$^2$; approximately a 80% pore volume; a resistance to air flow (Gurley Number) of approximately 5 seconds; and a Bubble Point of approximately 20 psi; and (2) a continuous, non-porous coating of polyurethane applied to the microporous expanded PTFE membrane in accordance with U.S. Pat. No. 4,194,041 in a layer comprising approximately 12 g/m$^2$. One preferred polyurethane comprises a HYPOL 2000 hydrophilic prepolymer available from W. R. Grace & Co., Lexington, Mass., cured with an amine curing agent.

The composite membrane has the following properties: a Burst Strength (restrained) of 170 psi; a Moisture Vapor Transmission Rate (MVTR) of approximately 13,000 g/m$^2$/day; a tensile strength of about 4,000 psi in the transverse direction and about 2,400 psi in the longitudinal direction; and a weight of about 29 g/m$^2$.

The resistance of the uncoated membrane to air flow was measured by a Gurley densometer (in accordance with ASTM Standard D726-58) manufactured by W. & L. E. Gurley & Sons. The results are reported in terms of Gurley Number which is the time in seconds for 100 cubic centimeters of air to pass through 1 square inch of a test sample at a pressure drop of 4.88 inches of water.

The Bubble Point of porous PTFE was measured using isopropyl alcohol following ASTM Standard F316-86. The Bubble Point is the pressure of air required to blow the first continuous bubbles detectable by the their rise through a layer of isopropyl alcohol covering the PTFE media. This measurement provides an estimation of maximum pore size.

Burst Strength was measured by employing a modified procedure similar to that set forth in ASTM Standard D751-89 employing a Mullen Type Hydrostatic Tester. The ASTM procedure was followed, except that a support of 1.8 oz. nylon taffeta fabric was applied over the membrane composite to prevent it from excessively stretching and breaking prematurely. The indicated pressure was the pressure at which water pressure ruptured the restrained membrane composite.

The Moisture Vapor Transmission Rate (MVTR) was determined by mixing approximately 70 ml of a solution consisting of 35 parts by weight of potassium acetate and 15 parts by weight of distilled water and placing it into a 133 ml polypropylene cup, having an inside diameter of 6.5 cm at its mouth. An expanded polytetrafluoroethylene (PTFE) membrane having a minimum MVTR of approximately 85,000 g/m$^2$/24 hrs. as tested by the method described in U.S. Pat. No. 4,862,730 to Crosby and available from W. L. Gore & Associates, Inc. of Newark, Del., was heat sealed to the lip of the cup to create a taut, leakproof, microporous barrier containing the solution. A similar expanded PTFE membrane was mounted to the surface of a water bath. The water bath assembly was controlled at 23° C. plus 0.2° C., utilizing a temperature controlled room and a water circulating bath.

The sample to be tested was allowed to condition at a temperature of 23° C. and a relative humidity of 50% prior to performing the test procedure. Samples were placed so the microporous polymeric membrane was in contact with the expanded polytetrafluoroethylene membrane mounted to the surface of the water bath and allowed to equilibrate for at least 15 minutes prior to the introduction of the cup assembly.

The cup assembly was weighed to the nearest 1/1000 g and was placed in an inverted manner onto the center of the test sample. Water transport was provided by the driving force between the water in the water bath and the saturated salt solution providing water flux by diffusion in that direction. The sample was tested for 5 minutes and the cup assembly was then removed, weighed again within 1/1000 g. The MVTR of the sample was calculated from the weight gain of the cup assembly and was expressed in grams of water per square meter of sample surface area per 24 hours.

The tensile strength was determined in accordance with ASTM D-882 (Tensile Properties of Thin Plastic Sheeting) using an Instron Tensile Tester, Series IX.

The above described material addresses the concern that the membrane 18 can be maintained waterproof even under conditions with heavy sweat contamination. As such, the inclusion of a continuous polyurethane or similar oleophobic coating on the expanded PTFE membrane serves to protect the waterproof properties of the membrane even when the membrane is exposed to extensive perspiration.

Although the waterproof/moisture vapor permeable material need only be provided facing the wearer in order to provide breathability, it is believed preferable that the entire cover 26 be made from such material in order to maximize moisture dissipation and prevent water and other contaminants from entering the material. Referring again to FIGS. 2 and 3, even though it is not presently known if moisture vapor passes through the armor layer 28 or around its edge through a gap 36 provided between the cover 26 and the plating layer 28, it has been demonstrated that body armor employing the waterproof/moisture vapor permeable cover of the present invention is noticeably more breathable and comfortable than previously available water resistant body armors.

In order for the pad 22 of the present invention to be fully effective in some uses, it may be desirable that all seams 38 holding multiple sheets **39*a*, 39*b* of the cover 26** together be properly sealed to avoid the leakage of water or condensate through the seams. Seam sealing can be accomplished in any accepted manner, such as through application of waterproof seam sealing tape, use of seam sealing adhesive or other chemical sealing product, ultra-sonic welding, fusing, heat sealing, etc.

It should be understood that without departing from the present invention, the panels of the present invention may be incorporated into a wide variety of other body armor devices to provide protection. Examples of possible applications include: armor lined coats, jackets, vests and other clothing; riot gear; animal protective armor; "police pouches" and other retractable panels; as well as hats, gloves, pants and other clothing. For these various applications the panels may take a variety of forms, from single panels covering the entire protected area to multiple panels oriented around one another to provide area protection.

Figure 6:
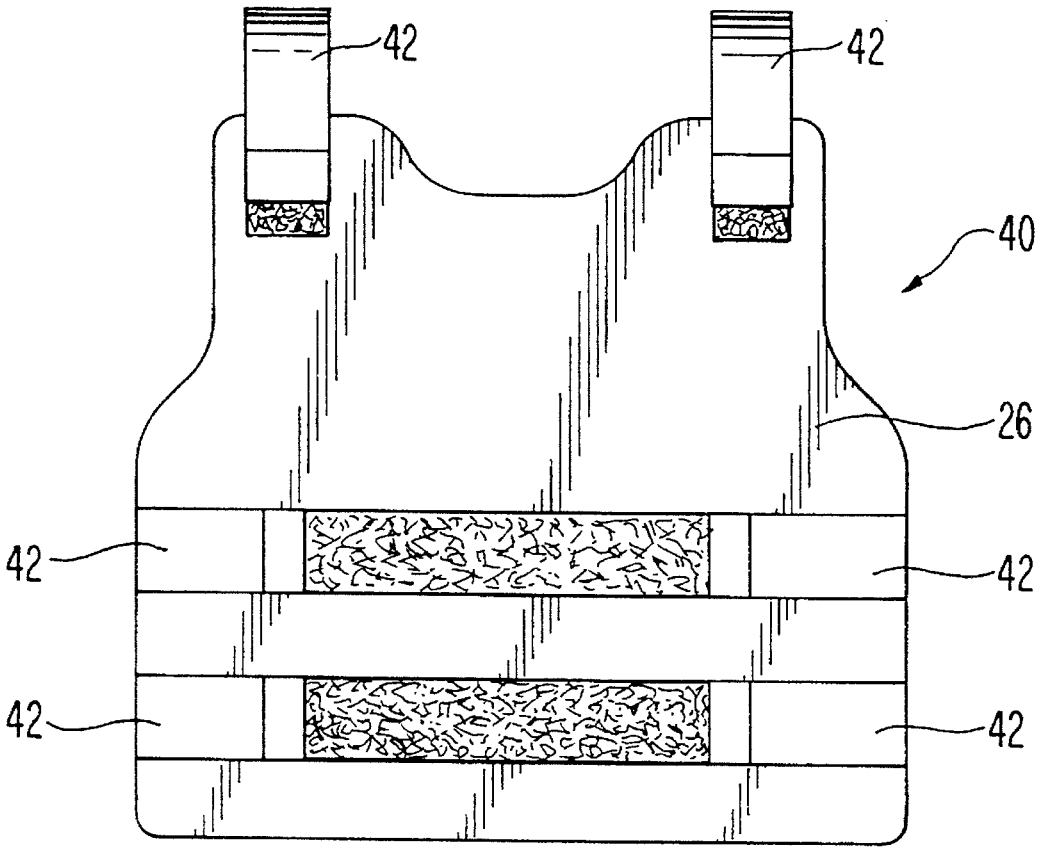
FIG. 6 is a front elevational view of another embodiment of a body armor vest of the present invention.

Another embodiment of body armor 40 of the present invention is shown in FIG. 6. In this embodiment, no separate carrier is employed. Instead, straps 42 are attached directly to the cover 26 of the armor plating. By eliminating the carrier, the bulk of the body armor is further reduced.

However, since the cover 26 of the present invention is highly breathable, this design remains quite comfortable to wear, without the "clammy" feeling which would be encountered with presently available vapor impermeable waterproof covers.

As should be evident from the above description, body armor made in accordance with the present invention is more wearable because of both improved breathability and improved armor panel flexibility. Since wearability is significantly better than other available body armors, the body armor of the present invention is expected to save more lives because it will be worn more often and more consistently.

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. Body armor to protect a wearer which comprises:

a penetration-resistant armor layer; and a cover surrounding and sealing the armor plating layer, the cover including at least a portion comprising a sheet of waterproof and moisture vapor permeable fabric oriented facing the wearer, the cover isolating the armor layer from water and perspiration absorption while permitting moisture vapor to escape from the wearer through the cover.

2. The body armor of claim 1 wherein the cover substantially consists of said waterproof and moisture vapor permeable fabric.

3. The body armor of claim 1 wherein the cover comprises multiple sheets of waterproof and moisture vapor permeable fabric attached together.

4. The body armor of claim 1 wherein the waterproof and moisture vapor permeable fabric comprises a porous polytetrafluoroethylene (PTFE) laminate.

5. The body armor of claim 4 wherein the cover comprises multiple sheets of waterproof and moisture vapor permeable fabric attached together by means of a sewn seam; and seam sealant covering the seam to prevent water from seeping into the armor layer through the seam.

6. The body armor of claim 4 wherein the porous PTFE laminate comprises an expanded PTFE coated with a layer of oleophobic material to prevent contamination of pores within the expanded PTFE.

7. The body armor of claim 1 which further comprises a carrier holding the armor layer and the cover against the wearer.

8. The body armor of claim 7 wherein the carrier includes a pocket into which the armor layer and cover can be removably inserted during wear.

9. The body armor of claim 1 which further comprises straps affixed directly to the cover to permit attachment of the body armor to a wearer.

10. The body armor of claim 1 wherein a gap is provided between the armor layer and the cover around a periphery of the armor layer to permit the passage of moisture vapor around the armor layer.

11. The body armor of claim 1 wherein the armor layer comprises multiple layers of a flexible aramid material stacked to form a penetration resistant armor.

12. A body armor for protection of a wearer from penetrating injury which comprises:

multiple layers of flexible material joined together to form an armor layer, the layers of flexible material being susceptible to compromise by water absorption; and a cover of a waterproof and moisture vapor permeable material surrounding the armor layer, the waterproof and moisture vapor permeable material shielding the armor layer from water absorption while allowing moisture vapor from the wearer to pass freely away from the wearer through the cover.

13. The body armor of claim 12 wherein the waterproof and moisture vapor permeable material comprises an expanded polytetrafluoroethylene (PTFE) film laminated to a fabric material.

14. The body armor of claim 13 wherein the expanded PTFE film is coated with a layer of polyurethane.

15. A method of creating an improved body armor for protection of a wearer from penetrating injury, which comprises:

providing a flexible armor panel;

providing a waterproof and moisture vapor permeable fabric material;

wrapping the armor panel with the waterproof and moisture vapor permeable material to form a water impermeable cover;

attaching the covered armor panel to the wearer, whereby the cover shields the armor panel from water absorption while permitting moisture vapor to pass away from the wearer.

16. The method claim of claim 15 that further comprises forming the cover from multiple sheets of waterproof and moisture vapor permeable material sewn attached together along a seam; and preventing water from penetrating into the cover by sealing the seam.

17. The method of claim 15 that further comprises attaching the body armor to the wearer by:

providing a carrier having straps for attachment to the wearer and including at least one pocket therein;

inserting the body armor into the pocket;

attaching the carrier to the wearer through use of the straps.

18. The method of claim 15 that further comprises attaching the body armor to the wearer by:

providing straps attached to the cover; and attaching the cover to the wearer through use of the straps.

19. Body armor to protect a wearer which comprises:

a penetration-resistant armor layer; and a cover surrounding and sealing the armor plating layer, the cover comprising a porous polytetrafluoroethylene (PTFE) laminate oriented facing the wearer, the cover isolating the armor layer from water and perspiration absorption, while permitting moisture vapor to escape from the wearer through the cover, the cover including a sewn seam which has disposed thereupon a seam sealant to prevent water from seeping into the armor layer through the seam.

20. A method of creating an improved body armor for protection of a wearer from penetrating injury, which comprises:

providing a flexible armor panel;

providing a waterproof and moisture vapor permeable fabric material;

wrapping the flexible armor panel with the waterproof and moisture vapor permeable material to form a water impermeable cover;

holding the cover together about the armor panel by providing at least one seam;

sealing the at least one seam to prevent water from penetrating within the cover;

attaching the covered armor panel to the wearer, whereby the cover shields the armor panel from water absorption while permitting moisture vapor to pass away from the wearer.

* * * * *

UNITED STATES PATENT AND TRADEMARK OFFICE
CERTIFICATE OF CORRECTION

PATENT NO. : 5,471,906

DATED : December 5, 1995

INVENTOR(S) : Thomas E. Bachner, Jr., David J. Pacanowsky

It is certified that error appears in the above-identified patent and that said Letters Patent is hereby corrected as shown below:

On the cover page, item [73] should read as follows:
Cover page, item [73] should read--
Assignee: Second Chance Body Armor, Inc., Central Lake, MI--.
W. L. Gore & Associates, Inc., Newark, DE Column 2, line 18: after "which" insert --is--.
Column 5, line 38: delete "the".
Column 8, line 29: delete "claim" (first occurrence).

Signed and Sealed this

Second Day of July, 1996

*Attest:*

Bruce Lehman

BRUCE LEHMAN

*Attesting Officer*

*Commissioner of Patents and Trademarks*